United States Patent [19]

Dier

[11] Patent Number: 4,554,817

[45] Date of Patent: Nov. 26, 1985

[54] VALVE SLEEVE SHAPING METHOD

[75] Inventor: Stephen A. Dier, Fraser, Mich.

[73] Assignee: TRW Inc., Cleveland, Ohio

[21] Appl. No.: 493,154

[22] Filed: May 10, 1983

[51] Int. Cl.[4] ..... B21D 53/00; B21D 53/10

[52] U.S. Cl. ..... 72/370; 72/393; 29/156.7 R; 29/157.1 R

[58] Field of Search ..... 72/125, 393, 394, 399, 72/370; 29/148 C, 156.5 R, 156.7 B, 156.7 C, 156.7 R, 157 C, 157.1 R; 409/143, 260, 299, 307; 137/625.3, 625.23

[56] References Cited

U.S. PATENT DOCUMENTS

| | | | |
|---|---|---|---|
| 1,420,875 | 6/1922 | Smith | 72/393 |
| 1,625,131 | 4/1927 | Miller | 72/355 |
| 1,648,189 | 11/1927 | Ottinger | 72/393 |
| 2,400,961 | 5/1946 | Thayer | 72/482 |
| 2,740,456 | 4/1956 | Laval, Jr. | 72/393 |
| 2,963,069 | 12/1960 | Pasternak | 72/393 |
| 3,067,801 | 12/1962 | Shortor | 72/393 |
| 3,263,474 | 11/1966 | Pentland | 72/370 |
| 3,371,514 | 3/1968 | Venables, III | 72/420 |
| 3,476,744 | 7/1969 | Leece | 72/125 |
| 3,591,136 | 2/1969 | Bishop | 137/625 |
| 3,680,422 | 8/1972 | Salvador | 72/355 |
| 3,800,386 | 4/1974 | Bishop | 72/76 |
| 4,100,785 | 7/1978 | Bishop | 72/189 |
| 4,103,407 | 8/1978 | Elizalde et al. | 29/157.1 R |
| 4,276,812 | 7/1981 | Dymond | 137/625.23 |
| 4,369,558 | 1/1983 | Iwata et al. | 29/149.5 B |
| 4,430,873 | 2/1984 | Oram | 72/125 |
| 4,442,579 | 4/1984 | Millard | 29/157.1 R |

FOREIGN PATENT DOCUMENTS

| | | | |
|---|---|---|---|
| 572160 | 3/1959 | Canada | 29/148.4 C |
| 55-128337 | 10/1980 | Japan | 29/149.5 B |
| 56-163967 | 12/1981 | Japan | 29/156.7 R |
| 57-177843 | 11/1982 | Japan | 29/149.5 B |
| 57-181737 | 11/1982 | Japan | 72/402 |
| 58-137533 | 8/1983 | Japan | 29/156.7 R |

*Primary Examiner*—Lowell A. Larson

*Attorney, Agent, or Firm*—Yount & Tarolli

[57] ABSTRACT

An apparatus is provided to shape the edges of flow control grooves in a valve sleeve. The apparatus includes a plurality of groove edge shaping tools which are pivotally supported in a circular array. A valve sleeve is telescoped over working end portions of the tools. A locator member engages an opening in the valve sleeve to hold the valve sleeve in radial alignment with the tools. A punch then forces a driver axially downwardly against the working end portions of the tools to pivot them radially outwardly against the edges of the grooves in the valve sleeve to shape the edges of the grooves. As the punch is subsequently withdrawn, a return spring moves a retainer upwardly against the tail end portions of the tools to pivot the tools inwardly out of engagement with the valve sleeve and to retain the tools in position out of engagement with the valve sleeve.

4 Claims, 7 Drawing Figures

VALVE SLEEVE SHAPING METHOD

BACKGROUND OF THE INVENTION

The present invention relates to a new and improved apparatus for shaping the edge of a groove in a valve sleeve. In particular, the present invention relates to an apparatus for shaping the edge of a groove formed in the internal surface of a cylindrical valve sleeve. The edge of the groove shaped by the apparatus is defined by the intersection of the internal surface of the valve sleeve and a surface which extends transverse to the axis of the valve sleeve.

A valve assembly for a vehicle power steering apparatus is disclosed in U.S. Pat. No. 4,276,812. The valve assembly includes a valve sleeve and a valve core located within the valve sleeve. The valve core and valve sleeve rotate relatively to control fluid flow through the valve assembly. Flow control grooves are formed in the internal surface of the valve sleeve. The internal flow control grooves have straight edges which extend parallel to the central axis of the valve sleeve. The groove edges are formed by the intersection of surfaces which extend transverse to the axis of the valve sleeve and the internal surface of the valve sleeve. When the valve sleeve and valve core are rotated relatively, fluid flows across the straight edges of the internal flow control grooves.

The flow control grooves in the valve sleeve of U.S. Pat. No. 4,276,812 are formed by an end mill. The end mill is first moved into the interior of the valve sleeve and rotated. The end mill is then moved into the material of the valve sleeve and moved axially of the valve sleeve to cut a groove in the internal surface of the valve sleeve.

Deflection of the milling tool results in the grooves cut in one valve sleeve not being identical to the grooves cut in another valve sleeve. As a result, the flow provided by one valve sleeve is not consistent with the flow provided by another valve sleeve. Thus, if the valve sleeves are used in power steering valves, each power steering valve would provide different steering reactions.

SUMMARY OF THE PRESENT INVENTION

The present invention is an apparatus for precisely shaping the edge of the grooves formed in the internal surface of a valve sleeve. This results in the flow from the grooves in one valve sleeve being substantially identical to the flow from the grooves in another valve sleeve. As a result, identical flow control is provided by each valve sleeve.

The apparatus of the present invention includes a plurality of groove edge shaping tools which are disposed in a circular array. The valve sleeve is telescoped over the circular array of shaping tools. A locator member retains each valve sleeve in a precise location relative to the shaping tools. The locator member engages the valve sleeve to hold the valve sleeve in a position in which grooves in the internal surface of the valve sleeve are disposed in radial alignment with the shaping tools.

The shaping tools are moved radially outwardly to shape the valve sleeve groove edges. Specifically, the shaping tools have working surfaces which engage and shape the groove edges. The shaping tools are precisely located relative to each other and relative to the valve sleeve when the valve sleeve is placed over the shaping tools. Also, the tools are controlled during their movement radially outwardly and are precisely returned to their retracted or at rest position. Thus, the groove edges in each valve sleeve are shaped precisely and identically by the shaping tools.

The apparatus includes a punch which moves a driver axially into the circular array of shaping tools. The driver has a portion which engages surfaces on the shaping tools and forces the shaping tools radially outwardly against the edges of the grooves in the valve sleeve as the driver moves axially into the valve sleeve. As the driver forces the shaping tools outwardly, the tools shape the edges of the grooves. As the punch is subsequently retracted, the driver is also retracted. The shaping tools are moved radially inwardly, out of engagement with the valve sleeve, by a retainer which positively engages the tools and moves them inwardly as the drive member retracts. The retainer has surfaces which positively engage and retain the embossing tools in their retracted position. The retainer releases the shaping tools for outward movement in response to the driver moving axially into the valve sleeve.

BRIEF DESCRIPTION OF THE DRAWINGS

The foregoing and other features of the present invention will become apparent to one skilled in the art upon consideration of the following detailed description taken in connection with the accompanying drawings wherein.

DESCRIPTION OF PREFERRED EMBODIMENT OF THE INVENTION

The present invention is an apparatus for shaping the edges of grooves formed in the interior of a valve sleeve. The valve sleeve is part of a valve assembly which includes a valve core located in the valve sleeve. Upon relative rotation of the valve sleeve and valve core, fluid is directed through the valve assembly, with some fluid being directed through the internal grooves in the valve sleeve. The valve assembly may be used in different control systems, but is preferably used in power steering systems. In power steering systems, the valve core and sleeve rotate relatively upon turning of the steering wheel. It is essential that each valve assembly operate as each other valve assembly. Otherwise different valve assemblies would provide different steering reactions. The present invention insures such consistent operation.

Figure 1:
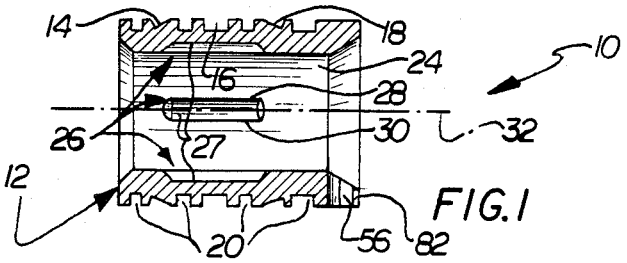
FIG. 1 is a sectional view of a valve sleeve having internal flow control grooves.
Figure 2:
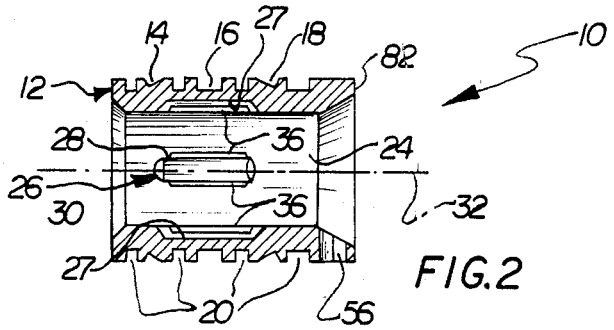
FIG. 2 is a sectional view of the valve sleeve of FIG. 1 after shaping of the edges of the flow control grooves in the valve sleeve.

Illustrated in FIG. 1 is a metal valve sleeve 10 intended for use in a power steering valve assembly. The valve sleeve 10 includes a hollow cylindrical body 12. A plurality of annular grooves 14, 16 and 18 are formed in the outside of the body 12 to conduct fluid. A plurality of annular grooves 20 are adapted to receive sealing rings and thus block leakage from the grooves 14, 16 and 18.

The valve body 12 has an inner cylindrical surface 24 in which a plurality of longitudinally extending flow control grooves 26 are formed. Each of the grooves 26 includes a groove defining surface 27 which intersects the surface 24. The intersection of the surfaces 24, 27 forms a pair of straight longitudinal edges 28 and 30. The edges 28 and 30 extend parallel to the central axis 32 of the valve sleeve 10.

The flow control grooves 26 are formed in the manner shown in U.S. Pat. No. 4,276,812. Specifically, they are formed by an end mill which is rotated and moved into the interior of the valve sleeve. The rotating end mill is moved into the material of the valve sleeve and moved axially along the valve sleeve to cut each groove. When performing these functions the end mill deflects. Thus the edges 28 and 30 of each groove 26 may be differently formed in one sleeve as opposed to another. Thus, one valve sleeve will be different from the next. This results in the flow control provided by the valve sleeves being inconsistent, leading to different steering reactions in power steering valves using the valve sleeves.

In order to provide valve sleeves 10 having grooves 26 with identically formed edges 28 and 30, the present invention provides for the identical shaping of the edges 28 and 30 of each groove 26 so that the final shape of the edges of each groove 26 is identical to the shape of the edges of every other groove 26.

The present invention is an apparatus 40 (FIG. 3) which is operable to shape by cold working the edges 28 and 30 of the grooves 26 in the valve sleeve 10. The apparatus 40 includes an upwardly extending mandrel 44. When the longitudinally extending grooves 26 of the valve sleeve 10 of FIG. 1 are to be shaped, the valve sleeve is telescoped over the mandrel 44 in the manner shown in FIG. 3. There is a radial clearance of approximately 0.001 inches between the valve sleeve 10 and the mandrel 44.

Figure 4:
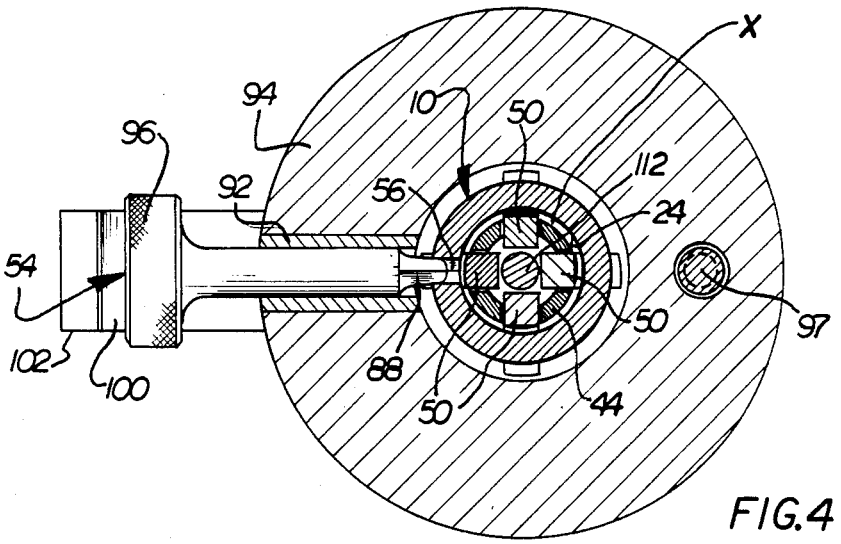
FIG. 4 is a sectional view, taken generally along the section line 4—4 of FIG. 3.
Figure 5:
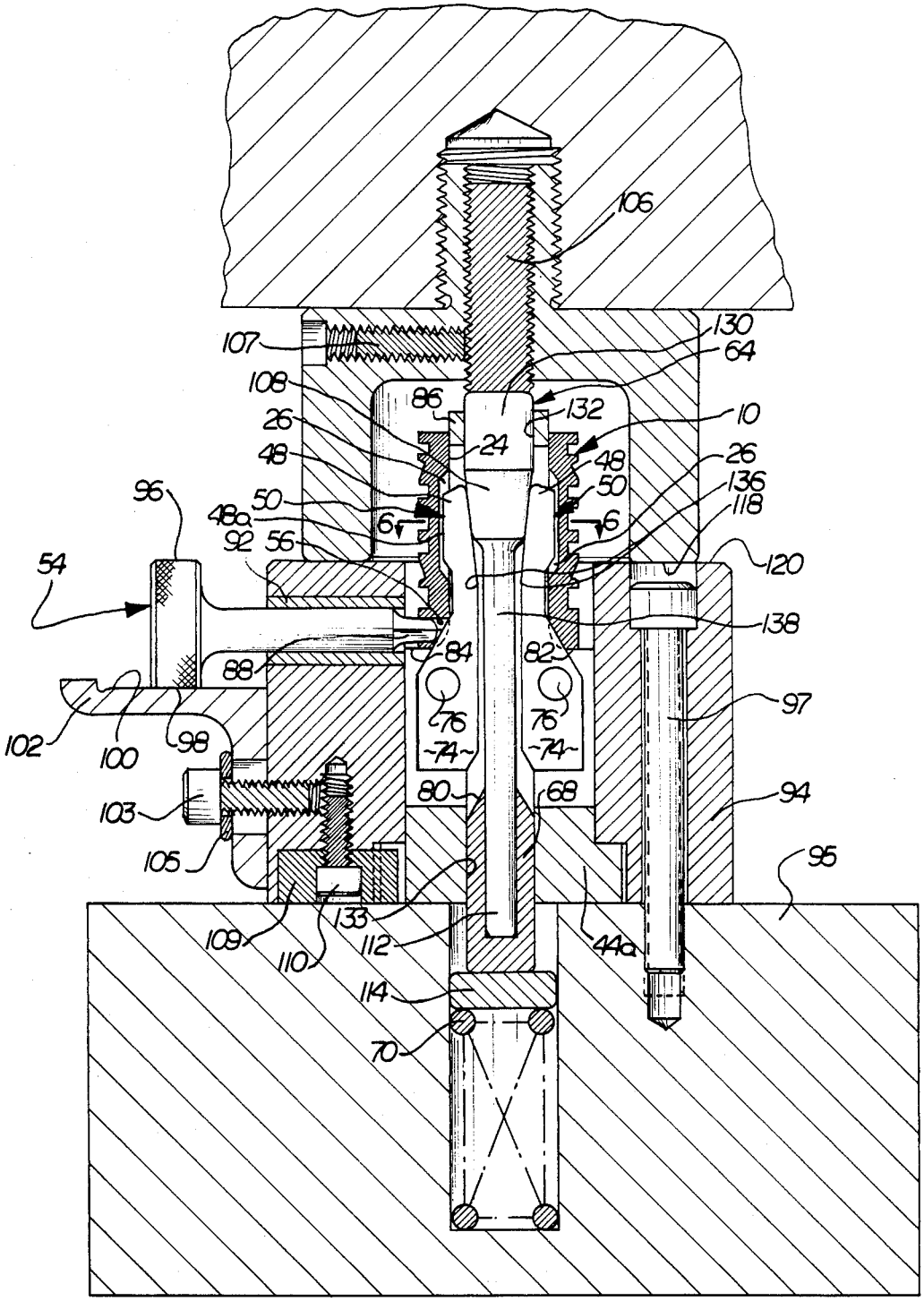
FIG. 5 is a sectional view of the apparatus of FIG. 3 illustrating the groove edge shaping tools in an extended position to which they are moved to shape the edges of the grooves in the valve sleeve.

As the valve sleeve 10 is telescoped downwardly over the mandrel 44, a circular lower end surface 82 of the valve sleeve 10 moves into abutting engagement with an annular shoulder 84 on the mandrel 44. This positions the valve sleeve 10 axially along the mandrel 44 so that the grooves 26 are axially aligned with the working end portions 48 of a plurality of shaping tools 50. The tools 50 are disposed in a circular array (see FIG. 4) on the mandrel 44. (The radial clearance X between the valve sleeve 10 and the mandrel 44 is exaggerated in FIG. 4 and the other Figures for purposes of clarity.) The tools 50 are pivotally movable from a retracted position (FIG. 3) in which the working end portions 48 are disengaged from the valve sleeve 10, to an extended position (FIG. 5). The working end portions 48 are operable to shape the edges 28 and 30 of the valve sleeve as they move to the position of FIG. 5.

Figure 6:
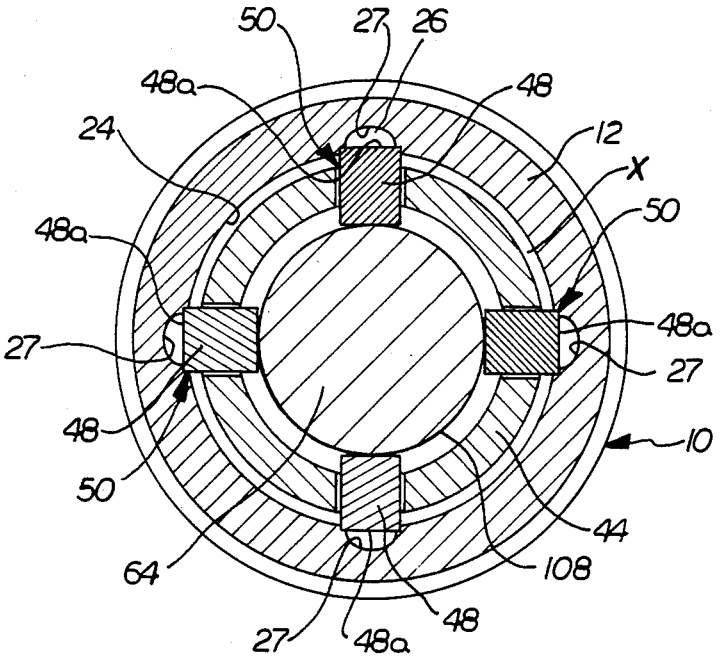
FIG. 6 is a sectional view of the apparatus of FIG. 5 taken approximately along the line 6—6 of FIG. 5.

The working end portions 48 of the tools 50 may have different cross sectional shapes depending upon the desired shape of the groove edges. As shown in FIG. 6, the end portion 48 has a generally rectangular shape. Specifically, the end portion 48 has a working surface **48*a* which engages the edges 28, 30 of a groove 26 to shape them. The tools 50 provide indentations 36** in the groove edges.

Figure 7:
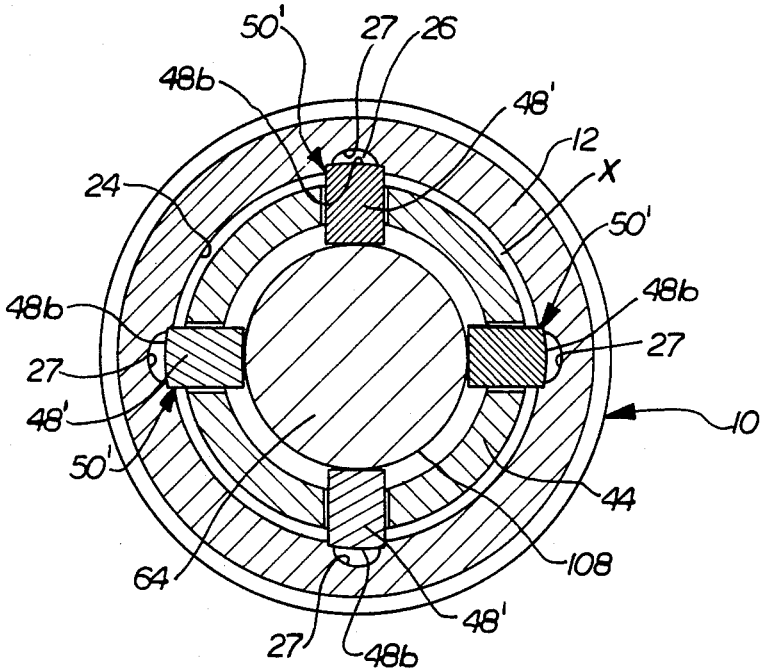
FIG. 7 is a sectional view similar to FIG. 6 but illustrating different shaping tools.

If it is desired to differently shape the edges of the grooves 26 in the valve sleeve 10, tools 50 having working end portions 48 with different shapes can be used. For example, FIG. 7 show tools 50' with a different shape for shaping the groove edges. Specifically, in FIG. 7, the working end portions 48' of the tools 50' have curved working surfaces **48*b* which engage and shape the edges 28, 30 of grooves 26. The edges 28, 30 of the grooves 26 shown in FIG. 7 thus take on a shape which is different from that of the edges 28, 30 of the grooves 26 shown in FIG. 6**.

Figure 3:
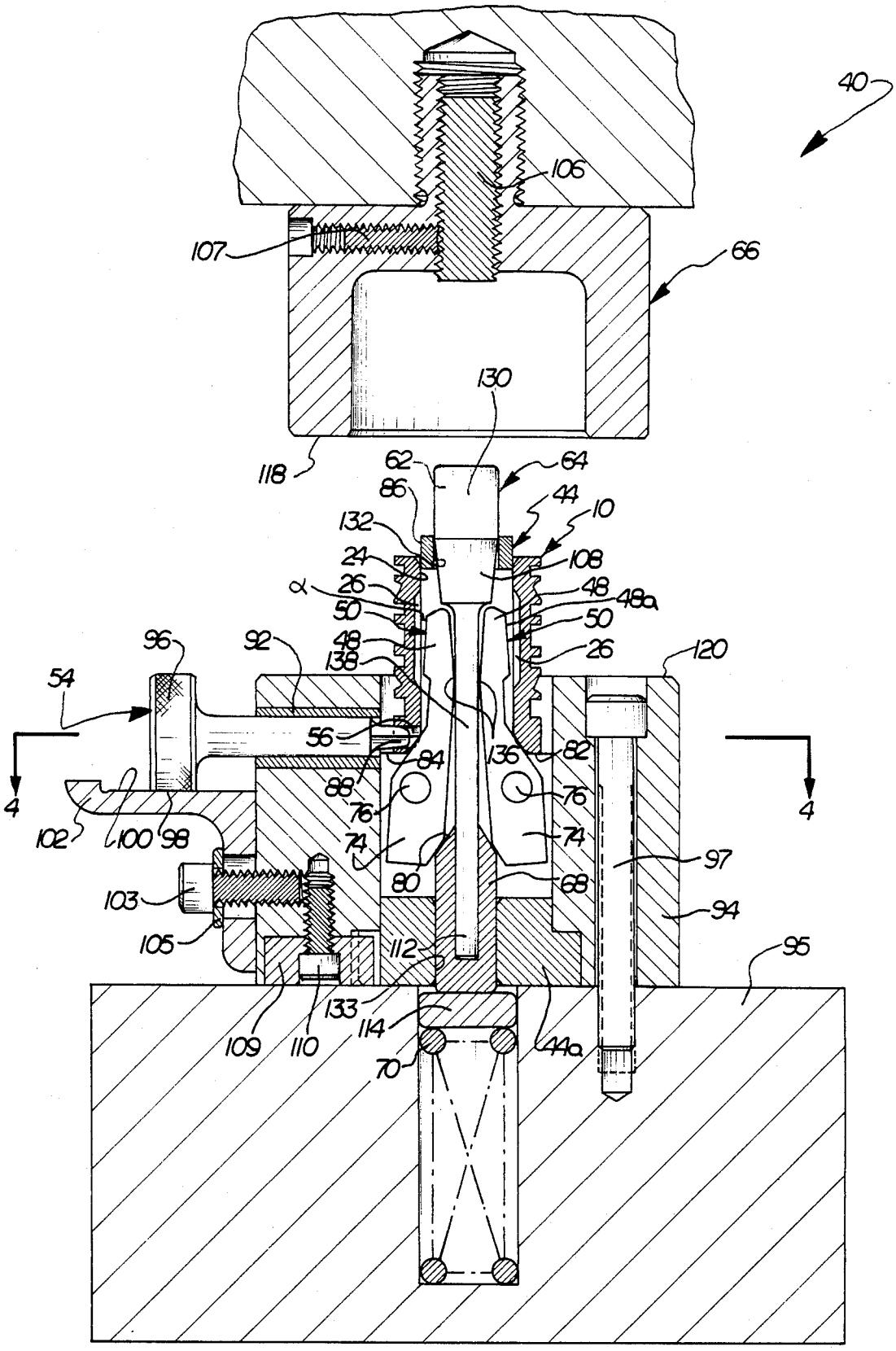
FIG. 3 is a sectional view of an apparatus for shaping the groove edges of the valve sleeve of FIG. 1, the apparatus being shown with a plurality of shaping tools in a retracted position.

The tools 50 (FIG. 3) each pivot about support pins 76. The working surface **48*a* of each tool 50 forms an acute angle $\alpha$ with the internal surface 24 of the valve sleeve 10 and thus form an acute angle $\alpha$ with the axis 32 of the valve sleeve 10 as shown in FIG. 3. The acute angle $\alpha$ is selected so that when the tools 50 are pivoted to their fully extended position (FIG. 5), the working surfaces 48*a* of the tools 50 lie in a plane parallel with the axis 32 of the valve sleeve 10. Thus, the indentations 36 formed on the groove edges 28 and 30 are of an even depth along the longitudinal extent of the grooves 26**.

After a valve sleeve 10 (FIG. 3) has been telescoped over the mandrel 44, the valve sleeve 10 is then rotated about the mandrel 44 until an opening 56 in the valve sleeve 10 is in radial alignment with a locator pin 54. The opening 56 in the valve sleeve 10 is disposed circumferentially around the valve sleeve 10, so that when the opening 56 in the valve sleeve 10 has been moved into alignment with a nose end portion 88 of the locator pin 54, the grooves 26 are aligned with the working end portions 48 of the tools 50. The locator pin 54 is then moved inwardly so that the nose end portion 88 of the locator pin engages the opening 56 in the valve sleeve 10.

The locator pin 54 locks the valve sleeve 10 into position to prevent movement thereof during the shaping operation. A cylindrical bushing 92 (FIG. 3) supports the locator pin 54 for axial movement relative to the housing 94, which is securely mounted on base 95 by threaded fasteners 97 (only one of which is shown). A head end portion 96 of the locator pin 54 has a flat 98, which engages a flat surface 100 on a bracket 102, to hold the locator pin 54 against rotation relative to the housing 94. Bracket 102 is held onto housing 94 by screw 103 and washer 105.

The nose 88 of the locator pin 54 is tapered, and has a polygonal configuration which corresponds to the opening 56 in the side of the valve sieeve. Tnerefore, as the locator pin is pressed into the opening 56, the valve sleeve is accurately positioned and held in alignment with the tools 50. This prevents undesirable relative movement between the valve sleeve 10 and the tools 50, and provides for accurate positioning of the valve sleeve 10 during the shaping of the edges of the grooves 26.

Mandrel 44 has its lower end **44*a* in housing 94. The mandrel 44 is prevented from rotating within the housing 94 by a key 109. The key 109 extends into a slot in the mandrel 44 and is held in place by screw 110**.

The apparatus 40 includes an actuator mechanism for moving the working surfaces **48*a* on the tools 50 into engagement with the groove edges 28, 30 to shape them, and for moving the working surfaces 48*a* out of engagement with the groove edges 28, 30 after they have been shaped. The actuator mechanism also retains the tools 50 in their retracted position of FIG. 3**.

The actuator mechanism includes a punch 66, a driver 64, a tool retainer 68 fixed on to the driver 64, a spacer 114, and a return spring 70. Once the grooves 26 in the valve sleeve have been positioned in axial and radial alignment with the tools 50, the punch 66 is lowered. As the punch 66 is lowered, a threaded plug 106 in the punch 66 engages a head end portion 62 of the driver 64. A frustoconical surface 108 on the head end portion 62 of the driver 64 moves downwardly into engagement with the working end portions 48 of the tools 50. As the driver 64 moves downwardly, a cylindrical lower end portion 112 of the driver 64 forces the retainer 68, which is fixed on to the lower end portion 112 of the driver 64, downwardly against the spacer 114 and the return spring 70 to thereby compress the return spring.

As the frustoconical surface 108 on the head end 62 of the driver 64 engages the working end portions 48 of the tools 50, the tools pivot outwardly about support pins 76. As the tools 50 pivot outwardly about the support pins 76 toward the extended position of FIG. 5, the working surfaces 48*a* on the end portions 48 of the tools 50 engage the longitudinally extending edge portions 28 and 30 of the grooves 26 to shape them. The working surfaces 48*a* on the the end portions 48 of the tools 50 force the metal at the edges 28 and 30 of the grooves 26 to move radially outwardly to form the indentations 36. At this time, end portions 48 of the tools 50 are disposed in a circular array having an outside diameter which is greater than the diameter of the inner cylindrical surface 24 of the valve sleeve 10. When the tools 50 are at their fully extended position as shown in FIG. 5, the working surfaces 48*a* (FIG. 6) preferably lie in planes which are parallel to the axis of the valve sleeve 10.

When the tools 50 reach their fully extended position shown in FIG. 5, an annular lower end surface 118 of punch 66 engages a circular top surface 120 of the housing 94 to stop the downward movement of the punch 66 and thereby the driver 64. This limits the extent to which the tools 50 are moved radially outwardly, to thereby limit the depth of the indentations 36. The threaded plug 106 in the punch 66 is selectively movable toward and away from the circular end surface 118 of the punch, to enable the extent to which the driver 64 is forced downwardly to be adjusted. A set screw 107 locks the threaded plug 106 in the selected position.

After the edges of the grooves 26 have been shaped, the punch 66 is retracted. As the punch 66 is retracted, return spring 70 expands, forcing spacer 114, retainer 68, and driver 64 upwardly from the position shown in FIG. 5 toward the position shown in FIG. 3. The frustoconical surface 108 is thereby removed from contact with the working end portions 48 of the tools 50, allowing the tools 50 to be free to be moved by spring 70 and retainer 68 from their extended position to their retracted position. As the retainer 68 moves upwardly, tapered actuator surface 80 on the retainer 68 engages the tail end portions 74 of the tools 50, to pivot the tools from the extended position of FIG. 5 to the retracted position shown in FIG. 3. The working end portions 48 of the tools 50 are now disposed in a circular array which has a smaller diameter than the internal surface 24 of the valve sleeve 10. When locator pin 54 is pulled axially outwardly, the valve sleeve 10 can then be removed from the mandrel 44.

The mandrel 44 prevents excessive flow of the metal of the valve sleeve 10 radially inwardly when the working surfaces 48*a* of the tools 50 shape the groove edges 28 and 30. When the working surfaces 48*a* of the tools 50 engage the edges 28, 30 of the grooves 26 to shape them, the close proximity of the outer surface 86 of the mandrel 44 to the inner surface 24 of the valve sleeve 10 will minimize radially inward flow of the metal as it is being shaped by the tools 50.

Any metal which may flow radially inwardly during the shaping operation is removed during a final honing step after the valve sleeve 10 is removed from the mandrel 44. Specifically, the inner cylindrical surface 24 of the valve sleeve 10 is honed to remove any excess metal and to effect the final sizing of the inside diameter of the valve sleeve 10. This final honing step provides an accurately sized inner cylindrical surface 24 on the valve sleeve 10 which is smooth so that a valve core located within the valve sleeve 10 may rotate freely relative to the valve sleeve, and unobstructed fluid flow occurs.

The driver 64 (FIG. 3) is held in precise coaxial alignment with the mandrel 44 and thereby the valve sleeve 10 in order to ensure an accurate at rest positioning of the tools 50. The head end portion 62 of the driver 64 has a cylindrical outer surface 130 which abuts a cylindrical inner side surface 132 of the mandrel 44, to thereby position and guide movement of the head end portion 62 of the driver 64. The cylindrical lower end portion 112 of the driver 64 is guided in its movement by surface 133 of the mandrel which defines an opening for the retainer 68. Thus, both ends of the driver 64, and therefore the entire body of the driver 64, are precisely positioned in coaxial alignment with the mandrel 44 at all times.

The radially inward movement of the tools 50 is limited by their contact with the driver 64. The tools 50 each include inner contact surfaces 136 which abut a cylindrical outer surface 138 of the central portion of the driver 64, when the tools 50 are in the retracted position (FIG. 3).

Each time a valve sleeve 10 is telescoped over the mandrel 44, the working end portions 48 of the tools 50 will be spaced apart precisely the same distance from the cylindrical inner side surface 24 of the valve sleeve 10. The tools 50 will thereby start their working movement from the same position each time a valve sleeve 10 is to have its groove edges shaped. This helps to ensure uniformity in the shaping operation from one valve sleeve to the next. This uniformity is also enhanced by the fact that the tools 50 are each pivotally mounted on support pins 76 which are fixedly joined to the mandrel 44. The tools 50 are thereby securely held in position relative to the mandrel 44.

By the present invention, production of valve sleeves is accomplished with both precision and consistency. The position of the tools 50 relative to the valve sleeve 10 is precisely controlled both in the at rest position as shown in FIG. 3 and in the fully extended position as shown in FIG. 5, thus contributing to accurate and controlled shaping of each individual valve sleeve 10. Because of the precision obtainable with this apparatus, the edges 28, 30 of grooves 26 are formed identically in each valve sleeve 10. This provides for identical fluid flow characteristics from one valve to another to avoid having a different steering reaction in each power steering valve utilizing a valve sleeve 10.

Furthermore, the present invention's provision of the locator pin 54 which engages and locates the valve sleeve 10, provides for simple, accurate, and repeatable positioning of each valve sleeve 10 relative to the mandrel 44 and therefore the tools 50. Accordingly, each valve sleeve 10 is properly positioned angularly relative to the working surfaces 48*a* of the tools 50. Again, this provides accuracy in forming the edges of the grooves 26 in each valve sleeve 10, and also provides consistency in operation of the valve sleeve.

Having described the invention, the following is claimed:

1. A method of shaping at least a portion of a groove edge of a groove on an internal surface of a valve sleeve, said groove edge being defined by the intersection of a groove defining surface and the internal surface of the valve sleeve, including the steps of:

mounting the valve sleeve in a surrounding relation to a tool having a working surface for shaping the groove edge, locating the groove edge in alignment with the working surface and fixing the valve sleeve in a predetermined aligned angular position with respect to the tool, moving the tool radially outwardly of the internal surface of the valve sleeve and into engagement with at least a portion of the groove edge to thereby effect shaping of said at least a portion of the groove edge, and moving the tool radially inwardly of said internal surface to return the tool to its initial position after shaping said at least a portion of said groove edge.

2. A method as set forth in claim 1 wherein said step of mounting the valve sleeve in a surrounding relation to a tool having a working surface for shaping the groove edge includes the step of mountng the valve sleeve in a surrounding relation to one end portion of the tool, and said step of moving the tool radially outwardly of the internal surface of the valve sleeve and into engagement with at least a portion of the groove edge comprises the step of moving said one end portion of the tool to effect pivotal movement of the tool about a pivot axis located intermediate the end portions of the tool.

3. A method as set forth in claim 2, said step of moving the tool radially inwardly of said internal surface comprises the step of moving a second end portion of the tool opposite said one end portion to effect pivotal movement of the tool about said pivot axis to move the tool radially inwardly of said internal surface.

4. A method as set forth in claim 1 wherein said step of mounting the valve sleeve in a surrounding relation to a tool comprises the step of mounting the valve sleeve in a surrounding relation to a plurality of tools disposed in a circular array within the valve sleeve to effect shaping of at least a portion of a plurality of groove edges of grooves in the internal surface of the valve sleeve, and said step of moving the tool radially outwardly of the internal surface of the valve sleeve includes the step of simultaneously moving said plurality of tools radially outwardly of the internal surface of the valve sleeve and into engagement with at least a portion of the groove edges of said plurality of groove edges.

* * * * *